US007057108B1

(12) United States Patent
Sodemann et al.

(10) Patent No.: US 7,057,108 B1
(45) Date of Patent: Jun. 6, 2006

(54) DUAL INPUT PLUG APPARATUS

(75) Inventors: Wesley C. Sodemann, Dousman, WI (US); Philip Gull, New Berlin, WI (US); Kenny J. Stair, North Prairie, WI (US); Dave Flegel, Watertown, WI (US)

(73) Assignee: Briggs & Stratton Power Products Group, LLC, Jefferson, WI (US)

( * ) Notice: Subject to any disclaimer, the term of this patent is extended or adjusted under 35 U.S.C. 154(b) by 0 days.

(21) Appl. No.: 11/195,998

(22) Filed: Aug. 3, 2005

(51) Int. Cl.
*H01B 7/00* (2006.01)

(52) U.S. Cl. ..... 174/71 R; 439/639; 439/626; 439/709; 439/107; 174/72 A

(58) Field of Classification Search ..... 174/71 R, 174/72 A; 439/638, 639, 626, 709, 107
See application file for complete search history.

(56) References Cited

U.S. PATENT DOCUMENTS 3,509,356 A 4/1970 Peebles
3,991,320 A 11/1976 Ross
4,053,788 A 10/1977 Robie
4,131,805 A 12/1978 Austin et al.
4,386,333 A 5/1983 Dillan
5,116,232 A * 5/1992 Follett ..... 439/107
5,160,852 A 11/1992 Charles et al.
5,245,219 A 9/1993 Romatzick, Jr. et al.
5,672,066 A 9/1997 Yeung
5,936,828 A 8/1999 Nolan et al.
D443,589 S 6/2001 Tong et al.
6,328,584 B1 12/2001 Follett
6,486,407 B1 11/2002 Hawker et al.
6,805,579 B1 * 10/2004 Marchand et al. ..... 439/502

* cited by examiner

*Primary Examiner*—Jinhee Lee
(74) *Attorney, Agent, or Firm*—Michael Best & Friedrich,LLP

(57) ABSTRACT

A cord for use with duplex receptacles that have first and second receptacles. The cord includes first and second sets of prongs insertable into the duplex receptacles to receive independent low-voltage electrical signals, and first and second receptacles connected in circuit to the first and second sets of prongs to deliver the independent low-voltage signals.

8 Claims, 2 Drawing Sheets

DUAL INPUT PLUG APPARATUS

BACKGROUND

The invention relates to electrical power cords, and more particularly, to electrical power cords having multiple inputs and outputs.

In the event of a power outage, a portable generator is often used to power certain appliances or electronics. However, using a portable generator often means that a user is only able to power a small number of appliances or circuits, due to the fact that portable generators typically only have a small number of outlets. Typically, large portable generators include a significant number of 120-volt outlets, but large generators are extremely heavy, hard to move, and expensive. Smaller, more economical generators are more appealing to some users than larger generators, with the trade-off of having fewer outlets. A smaller generator may, for example, have four 120-volt 3-prong outlets and one 240-volt, four-prong outlet.

In the event of a short-termed power outage, most users do not need to utilize the 240-volt outlet, but rather would like to use additional 120-volt outlets to run more appliances, such as a window-mounted air conditioner, a hair dryer, and a refrigerator, without having to purchase a larger, portable generator.

Furthermore, electrical signals such as current supplied through the 120-volt outlets are generally dependent on each other. That is, the magnitude of the electrical signals drawn from one of the 120-volt outlets directly affects the magnitude of the electrical signals drawn from the other 120-volt outlets.

SUMMARY

In one form, the invention provides a cord for use with first and second adjacent receptacles including but not limited to duplex receptacles. The cord includes a plug housing, a first set of prongs, a second set of prongs, a first flexible conduit portion, a second flexible conduit portion, a first receptacle, a third flexible conduit portion, and a second receptacle. Particularly, the first set of prongs, which includes a first neutral prong, extends from the plug housing to be inserted into the first receptacle to receive a first low-voltage electrical signal. The second set of prongs, which includes a second neutral prong, extends from the plug housing to be inserted into the second receptacle of the duplex receptacles to receive a second low-voltage electrical signal. Furthermore, the first flexible conduit portion extends from the plug housing, while the second flexible conduit portion is connected in circuit to the first flexible conduit portion. The first receptacle is connected in circuit to the second flexible conduit portion and the first neutral prong to deliver the first low-voltage electrical signal. The third flexible conduit portion is connected in circuit to the first flexible conduit portion. The second receptacle is connected in circuit to the third flexible conduit portion and the second neutral prong to deliver the second low-voltage electrical signal.

In another form, the invention provides an electrical power cord operable to receive power from first and second adjacent receptacles such as duplex receptacles, and to output power. The cord includes a plug housing, an input cord, a first output cord, and a second output cord. The plug housing receives power from the duplex receptacles with first and second prongs. The input cord, which is connected to the plug housing, includes a first input power conductor, a second input power conductor, a first input neutral conductor connected to the first prong, a second input neutral conductor connected to the second prong, and a ground conductor. The first output cord is connected to a first output terminal to output power. The first output cord and the first output terminal include a first output power conductor that is electrically connected to the first power conductor, a first output neutral conductor that is electrically connected to the first input neutral conductor, and a first output ground conductor that is electrically connected to the ground conductor. The second output cord is connected to a second output terminal to output power. The second output cord and the second output terminal include a second output power conductor that is electrically connected to the second input power conductor, a second output neutral conductor that is electrically connected to the second input neutral conductor, and a second output ground conductor that is electrically connected to the ground conductor.

In yet another form, the invention provides an electrical power generating system that includes a generator, a panel coupled to the generator, and first and second receptacles. The generator includes a first coil to generate a first low-voltage electrical signal through a first power conductor, and a second coil operable to generate a second low-voltage electrical signal through a second power conductor that is electrically isolated from the first power conductor. The first receptacle is coupled to the panel, and is connected in circuit to the first coil to deliver the first low-voltage electrical signal. The second receptacle is coupled to the panel, and is connected in circuit to the second coil to deliver the second low-voltage electrical signal. The system also includes a cord to be inserted into the receptacles. The cord has a plug housing, a first set of prongs and a second set of prongs. The first set of prongs extends from the plug housing, and is insertable into the first receptacle of the generator to receive the first low-voltage electrical signal from the generator. The second set of prongs also extends from the same plug housing, and is insertable into the second receptacle of the generator to receive the second low-voltage electrical signal from the generator.

Thus, in one embodiment, the invention provides a generator that uses two coils and a respective electrically isolated power conductors connected to each of the two coils to generate two power signals or two low-voltage electrical signals such as two 120 VAC signals through respective adjacent outlets coupled to a face plate or control panel. The power or electrical signals supplied to an appliance connected to one of the 120-VAC outlets are independent from the power or electrical signals supplied to another appliance connected to the other of the 120-VAC outlets, when the generator is operating at a stable speed. However, when a large load is connected to one of the outlets, the speed of the generator's engine may change, which may affect the power available at the other outlet. In this way, when the generator is operating near the normal operating speed, the users are provided with options to use multiple 120-VAC appliances.

The invention also provides an electrical cord with flexible conduit that delivers 120-VAC electrical signals such as current and/or voltage to any connected appliances through multiple pairs of cord output receptacles. Particularly, the electrical signals available at one pair of cord output receptacles are independent from the electrical signals available at another pair of cord output receptacles, when the generator is operating near its normal operating speed.

The cord according to the present invention receives two 100–125 VAC input signals, and outputs two sets of output signals to power loads. Each set of outputs can deliver 15 or 20 Amps.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Embodiments of the invention will also be described with reference to the accompanying drawing figures wherein like numbers represent like elements throughout. Certain terminology, for example, "top, ""bottom," "right," "left," "front," "frontward," "forward," "back," "rear," and "rearward," is used in the following description for relative descriptive clarity only and is not intended to be limiting.

Embodiments of the invention relate to an apparatus for use with duplex receptacles, or other pairs of adjacent receptacles. In one embodiment, the apparatus includes a cord that can be inserted into the receptacles of the power source to receive low-voltage electrical signals, and to output multiple low-voltage electrical signals. In another embodiment, the apparatus includes a back up power system that generates low-voltage signals. The receptacles could be connected to a generator output or control panel, or to a building.

Figure 1:
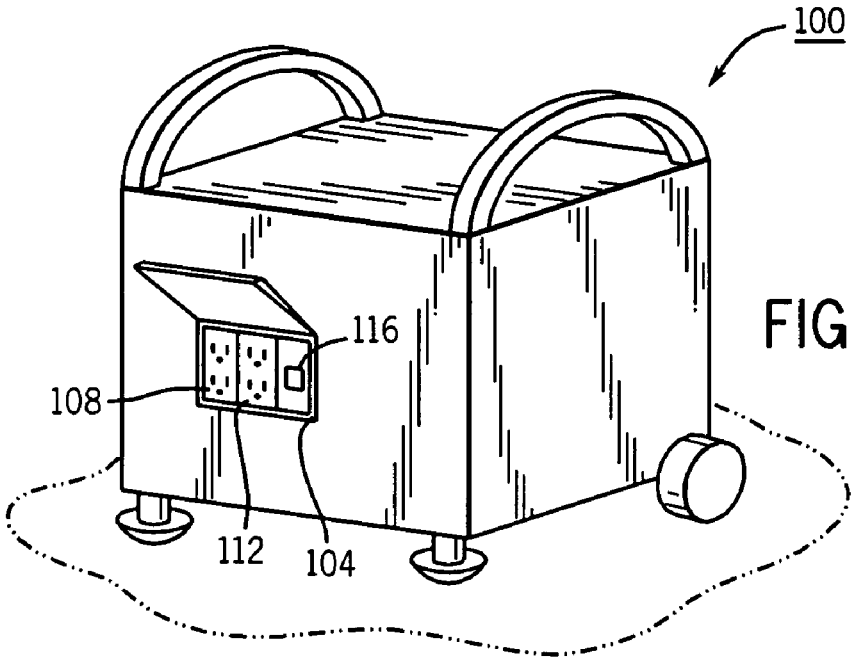
FIG. 1 is a perspective view of a generator.

FIG. 1 is a perspective view of a portable generator 100 that includes a control panel 104. FIG. 1 also shows that the control panel 104 includes a plurality of components 108, 112, 116. Although three components 108, 112, 116 are shown, the control panel 104 can have other number of components depending on applications. In the embodiment shown, the components 108, 112 are a duplex modular 3-prong outlets or receptacles that can receive typical household 2-prong or 3-prong plugs. The component 116 provides other functionalities such as a circuit breaker and a fuse. However, the two receptacles have two power conductors in each duplex module. The two power conductors are electrically independent in that one of the power conductors is electrically isolated from the other power conductor, while the receptacles can share a common ground. In some embodiments, the neutral conductor of one of the receptacles can also be tied to the neutral conductor of the other receptacle. In this way, electrical signals available at one of the receptacles are independent from electrical signals available at the other of the receptacles. Although a generator is shown as a power source, typical residential or other building duplex receptacles or a receptacle pair can also be used as power source.

Figure 2:
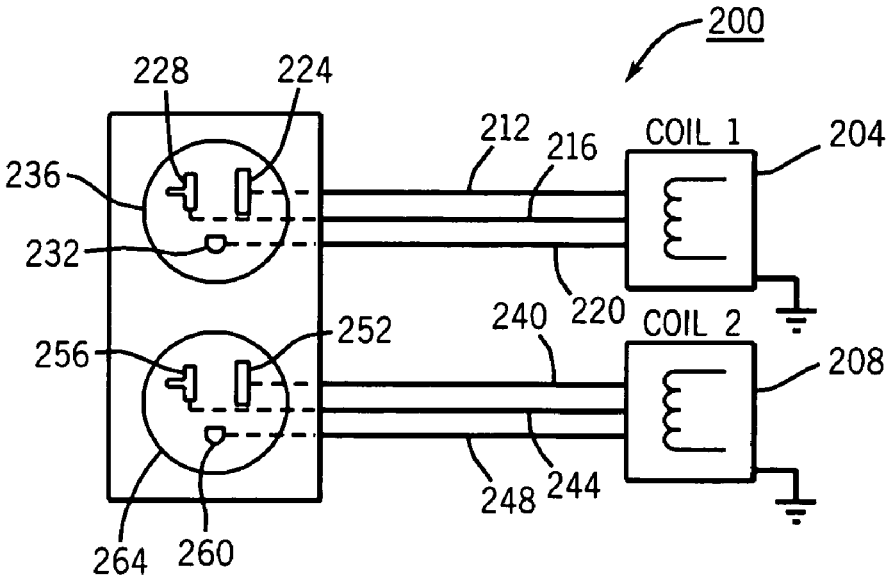
FIG. 2 is a schematic circuit diagram of a plurality of electrical coils in the generator in FIG. 1.

FIG. 2 is a schematic circuit diagram 200 showing a plurality of electrical coils 204, 208 in the generator 100 in FIG. 1. The coils 204, 208 are generally electrically independent from each other. That is, when the coils 204, 208 are supplying electrical signals such as current to the components 108, 112, the magnitude of the electrical signals supplied to one of the 3-prong receptacles is generally independent from the magnitude of the electrical signals supplied to the other of the 3-prong receptacle of the same component. Particularly, each of the coils 204, 208 has a respective ground. The coils 204, 208 typically have a common neutral, but the neutral could be independent. The coils 204 couple a first power conductor 212 such as a hot conductor, a second power conductor 216 such as neutral, and a first ground conductor 220 to a first power contact 224, a second power contact 228, and a first ground contact 232, respectively, of a first receptacle 236 on one of the modular panels 108, 112. Similarly, the coils 208 couple a third power conductor 240 such as a hot conductor, a fourth power conductor 244 such as neutral, and a second ground conductor 248, respectively, to a third power contact 252, a fourth power contact 256, and a second ground contact 260 of a second receptacle 264 on one of the components 108, 112. Furthermore, the coils 204 are configured to generate a first low-voltage electrical signal and supply the first low-voltage electrical signal to the first receptacle 236, while the coils 208 are also configured to generate a second low-voltage electrical signal and supply the second low-voltage electrical signal to the second receptacle 264. In some embodiments, both the first and second low-voltage signals range from about 100 volts to about 125 volts. Although the first and second low-voltage signals are generally electrically independent from each other, the first and second low-voltage signals have about equal amplitudes.

Figure 3:
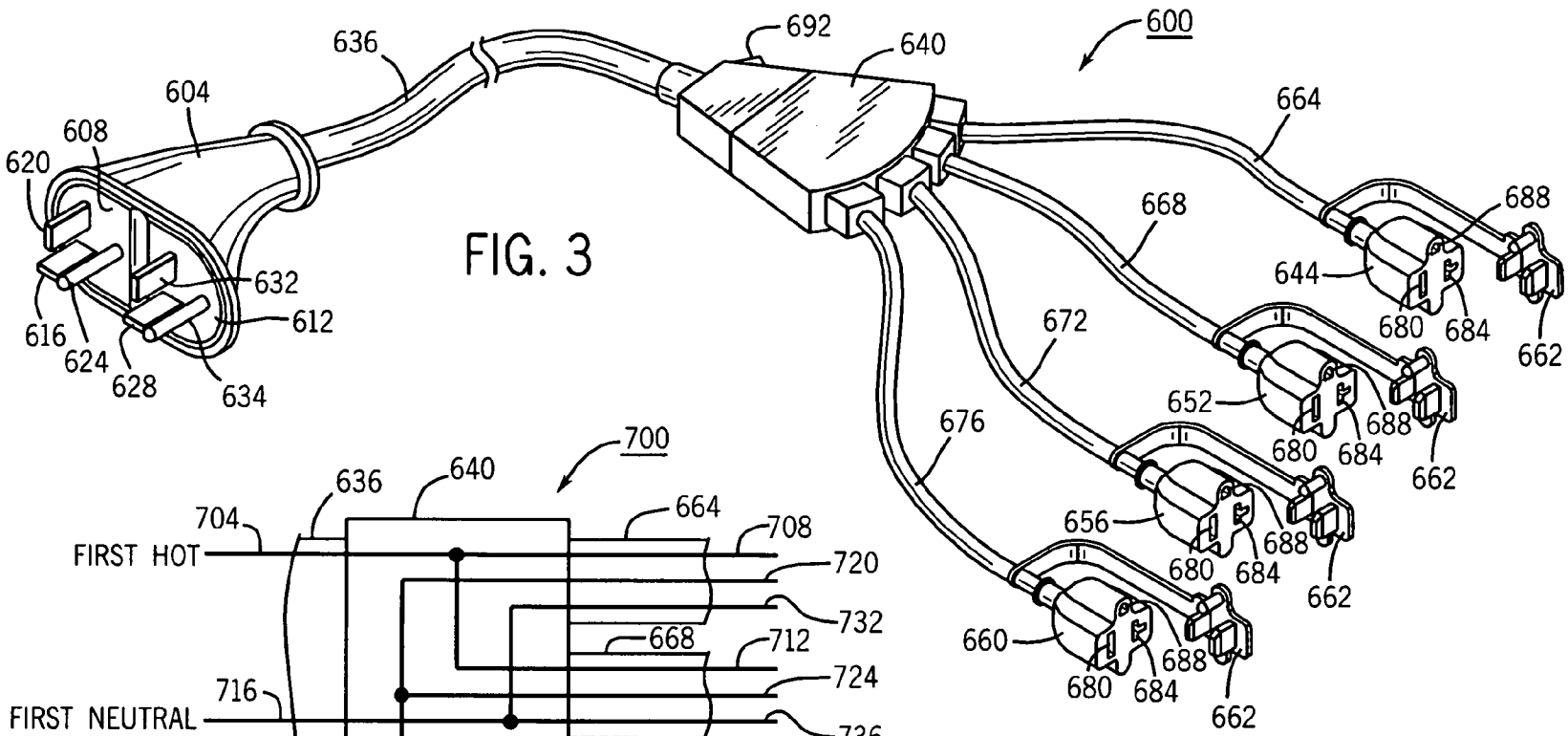
FIG. 3 is perspective view of an electrical power cord.

FIG. 3 is a perspective view of an electrical power cord 600 that can be used with the generator 100 in FIG. 1 to receive two low-voltage electrical signals and to deliver multiple low-voltage electrical signals. The cord 600 is configured to be inserted into or connected with the generator 100 of FIG. 1 to receive first and second low-voltage signals, and outputs the low-signals through a plurality of receptacles. While the first and second low-voltage signals are generally electrically independent from each other, (but both are dependent on the engine source's frequency) the first and second low-voltage signals typically have about equal amplitudes. In some embodiments, the low-voltage signals range from about 100 volts to about 125 volts. Furthermore, the cord 600 can have different lengths to meet different application requirements.

In the embodiment shown, the cord 600 includes a bridge plug housing 604 typically potted with insulating materials. The bridge plug housing 604 includes first and second set of prongs 608, 612 that extend from the housing 604. Although the bridge plug housing 604 are shown having only two sets of prongs, the bridge plug housing 604 can include other number of sets of prongs to be connected with different generators, or any other adjacent receptacles. The first and second set of prongs 608, 612 can be inserted into the first and second receptacles 236, 264 of the generator 100 as shown in FIG. 1, or some other adjacent receptacles, to receive the first and second low-voltage electrical signals, respectively.

The first set of prongs 608 includes a first power blade or prong 616 such as a hot prong, a first neutral blade or prong 620, and a first ground 624; whereas the second set of prongs 612 includes a second power blade or prong 628, a second neutral blade or prong 632, and a second ground 634. The first and second ground prongs 624, 634 can be electrically connected in the cord 600, detailed hereinafter. The prongs 616, 620, 624 of the first set 608, and the prongs 628, 632, 634 of the second set 612 also generally conform to National Electrical Manufacturers' Association ("NEMA") 5–15R/20R standards. In some embodiments, when inserted into the first and second receptacles 236, 264 of the generator 100, the prongs 616, 620, 624, 628, 632, 634 are connected in circuit with the contacts 228, 224, 232, 256, 252, 260, respectively. That is, the first power prong 616 is connected in circuit to the first power contact 228, the first neutral prong 620 is connected in circuit to the power contact 224, and the ground prong is connected in circuit to the ground contact 232. Similarly, the second power prong 628 is connected in circuit to the second power contact 252, the second neutral prong 632 is connected in circuit to the second neutral contact 256, and the second ground prong 634. In other embodiments, the bridge housing 604 can also include two sets of 2-prong plugs that connect to respective power and neutral contacts.

The cord 600 also includes a first flexible conduit 636 that extends from the housing 604, and an optional transitional housing 640 that connects to the first flexible conduit 636. Particularly, the first flexible conduit 636 transitions into a plurality of secondary flexible conduits 664, 668, 672, 676 at the transition housing 640. In the embodiment shown, the transitional housing 640 includes therein a plurality of conductors that are connected in circuit to the prongs 616, 620, 624, 628, 632, 634, and contacts of a plurality of low-voltage outlets or receptacles 644, 652, 656, 660 via the secondary flexible conduits 664, 668, 672, 676. Each of the low-voltage receptacles 644, 652, 656, 660 is protected with a protection plug 662 that includes insulating material extension that insulate the contacts of the receptacles 644, 652, 656, 660 from their respective environment. Although FIG. 3 shows four low-voltage outlets or receptacles 644, 652, 656, 660, the cord 600 can include more or less low-voltage outlets or receptacles than shown. Particularly, each of the low-voltage receptacles 644, 652, 656, 660 includes a power contact 680, a neutral contact 684, and a ground contact 688 to the conductors in the transitional housing 640, detailed hereinafter.

Figure 4:
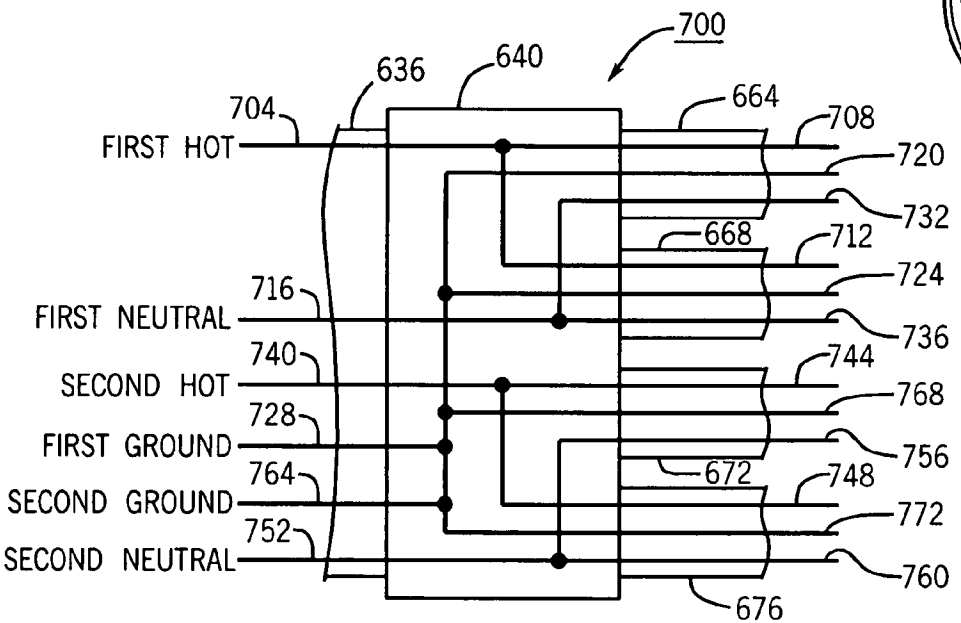
FIG. 4 is a schematic circuit diagram of the electrical power cord of FIG. 3.

FIG. 4 is a schematic circuit diagram 700 of a portion of the electrical power cord 600 and illustrates how the transition housing 640 or the bridge plug housing 604 houses or connects conductors and prongs in the bridge plug housing 604 with conductors and receptacle contacts in the secondary conduits 664, 668, 672, 676 and the receptacles 644, 652, 656, 660. Particularly, the circuit diagram 700 shows a first hot conductor 704 that is connected in circuit to the first power prong 616 on one end. The first hot conductor 704 is also connected to the power contacts 680 of the receptacles 644, 652 with respective conductors 708, 712 on the other end. Similarly, a first neutral conductor 716 is connected to the first neutral prong 620 on one end. The first neutral conductor 716 is also connected to the neutral contacts 684 of the receptacles 644, 652 with respective conductors 720, 724. A first ground conductor 728 is connected to the first ground prong 624, and to the ground contacts 688 of the receptacles 644, 652 with respective conductors 732, 736. Furthermore, a second hot conductor 740 is connected to the second power prong 628, and to the power contacts 680 of the receptacles 656, 660 with respective conductors 744, 748. Similarly, a second neutral conductor 752 is connected to the second neutral prong 632, and to the neutral contacts 684 of the receptacles 656, 660 with respective conductors 756, 760. A second ground conductor 764 is connected to the second ground prong 634, and to the ground contacts 688 of the receptacles 656, 660 with respective conductors 768, 772. In some embodiments, the cord 600 also includes a breaker member 692 that interrupts the electrical signals supplied from the generator 100 through the first and second receptacles 236, 264 to the first and second set of prongs 608, 612 of the cord 600. The breaker member 692 in some cases can be a fuse or a breaker circuit. Although the breaker member 692 is shown connected to the transitional housing 640, the breaker member 692 can also be housed in the bridge plug housing 604.

In the event of power outage or to reduce the number of extension cords, a user can insert the first and second set of prongs 608, 612 of the cord 600 into adjacent receptacles, the first and second receptacles 236, 264 of the generator 100, or any other duplex receptacles of a building to receive low-voltage electrical signals (such as a 120 VAC signal). The user then has an option of connecting low-voltage appliances to the receptacles 644, 652, 656, 660.

Thus, the invention provides, among other things, a cord for use with a generator or a building having adjacent receptacles. Various features and advantages of the invention are set forth in the following claims.

What is claimed is:

1. A cord for use with first and second receptacles adjacent to each other, the first and second receptacles having respective first and second power conductors, each of the power conductors being electrically isolated from the other of the two power conductors, the cord comprising:

a plug housing;

a first set of prongs extending from the plug housing, being insertable into the first receptacle, and configured to receive a first low-voltage electrical signal through the first receptacle, the first set of prongs comprising: a first neutral prong and a first power prong;

a second set of prongs extending from the plug housing, being insertable into the second receptacle, and configured to receive a second low-voltage electrical signal through the second receptacle, the second set of prongs comprising:

a second neutral prong and a second power prong;

a first secondary flexible conduit portion connected in circuit to the first neutral prong and to the first power prong;

wherein the first receptacle is connected in circuit to the first flexible conduit portion and the first neutral prong, and is configured to deliver the first low-voltage electrical signal;

a second secondary flexible conduit portion connected in circuit to the second neutral prong and to the second power prong, wherein the first and second power prongs are electrically isolated from each other; and wherein the second receptacle is connected in circuit to the second secondary flexible conduit portion and the second neutral prong, and is configured to deliver the second low-voltage electrical signal, wherein the cord further comprises a transitional housing interconnecting the plug housing with the first and second secondary flexible conduit portions, and wherein the first secondary flexible conduit portion is adjacent the second secondary flexible conduit portion.

2. The cord of claim 1, further comprising a third secondary flexible conduit portion connecting the transitional housing in circuit to the plug housing.

3. The cord of claim 1, wherein the first set of prongs further comprises a first ground prong, and wherein the second set of prongs further comprises a second ground prong.

4. The cord of claim 1, wherein the first and second low-voltage electrical signals range between about 100 volts and about 125 volts.

5. The cord of claim 1, further comprising a breaker configured to interrupt at least one of the first and second electrical signals supplied through the first and second receptacles to the first and second sets of prongs when at least one of the first and second electrical signals is above a threshold.

6. The cord of claim 5, wherein the breaker comprises at least one of a fuse and a circuit breaker.

7. The cord of claim 1, wherein the first receptacle further comprises at least one of a first power contact and a ground contact.

8. The cord of claim 1, wherein the second receptacle further comprises at least one of a second power contact and a second ground contact.

* * * * *